US010737928B2

(12) United States Patent
Wiersma

(10) Patent No.: US 10,737,928 B2
(45) Date of Patent: Aug. 11, 2020

(54) NOZZLE FOR DELIVERY OF AUXILIARY OR ADDITIVE FLUID FOR TREATING EXHAUST FOR A DIESEL MOTOR FOR AUTOS OR TRUCK VEHICLE OR THE LIKE

(71) Applicant: Roger Wiersma, Pacific, MO (US)

(72) Inventor: Roger Wiersma, Pacific, MO (US)

(73) Assignee: Husky Corporation, Pacific, MO (US)

( * ) Notice: Subject to any disclaimer, the term of this patent is extended or adjusted under 35 U.S.C. 154(b) by 0 days.

(21) Appl. No.: 16/501,075

(22) Filed: Feb. 19, 2019

(65) Prior Publication Data

US 2019/0263654 A1 Aug. 29, 2019

Related U.S. Application Data

(60) Provisional application No. 62/710,677, filed on Feb. 23, 2018.

(51) Int. Cl.
*B67D 7/52* (2010.01)
*B67D 7/34* (2010.01)
(Continued)

(52) U.S. Cl.
CPC ..... *B67D 7/52* (2013.01); *B67D 7/04* (2013.01); *B67D 7/34* (2013.01); *B67D 7/50* (2013.01)

(58) Field of Classification Search
CPC ... B67D 7/02; B67D 7/04; B67D 7/34; B67D 7/42; B67D 7/44; B67D 7/50; B67D 7/52; B67D 2007/0474; B67D 2007/0419
(Continued)

(56) References Cited

U.S. PATENT DOCUMENTS 2,556,221 A * 6/1951 Samiran ..... B67D 7/42 141/224
3,521,679 A 7/1970 Copony
(Continued)

FOREIGN PATENT DOCUMENTS

EP 0687647 A1 6/1995

*Primary Examiner* — Timothy L Maust
(74) *Attorney, Agent, or Firm* — Paul M. Denk

(57) ABSTRACT

An auxiliary or additive fluid for associated use with the primary diesel or related fuel, for application for reduction of exhaust pollution, and for motor or truck vehicle, or the like, includes the nozzle, the nozzle having its spout extending from its forward end, the spout having an outer sleeve, an inner sleeve through which the fluid flows during dispensing, a lower sleeve capable of shifting within the outer sleeve, and integrated with a safety valve sleeve, and biased axially inwardly of the spout when it is inserted into the fluid intake pipe of a vehicle intake for a fluid tank. A primary safety valve extends through the lower spout sleeve, and the integral safety valve sleeve is maintained in a fixed position, and normally is sealed into closure within the lower end of the lower spout sleeve. But, when the lower spout sleeve is forced axially inwardly, it unseats the safety valve from its sealing therewith, to open the spout for the dispensing of the fuel when the nozzle is actuated to allow fluid flow. In addition, a flow path for air that is normally closed by a check valve, is likewise opened, to allow for the passage of air to maintain the inoperativeness of the automatic shut-off, until such time as the fluid flow closes off the lower end said passage, initiating the automatic shut-off of the fluid dispensing nozzle, when the intake of air is blocked.

3 Claims, 2 Drawing Sheets

(51) Int. Cl.
*B67D 7/04* (2010.01)
*B67D 7/50* (2010.01)

(58) Field of Classification Search
USPC ..... 141/59, 206, 311 A, 351
See application file for complete search history.

(56) References Cited

U.S. PATENT DOCUMENTS 4,331,187 A 5/1982 Trygg
4,338,801 A 7/1982 Beitecke et al.
4,638,842 A * 1/1987 Hawley ..... B67D 7/42 141/302
5,346,260 A 9/1994 Meyer-Berg et al.
5,474,115 A 12/1995 Fink, Jr.
5,562,133 A 10/1996 Mitchell
5,704,522 A 6/1998 Orgeolet et al.
5,806,217 A 9/1998 Alvern
5,864,975 A 2/1999 Alvern
6,112,782 A 9/2000 Farthing
6,123,123 A 9/2000 Carder, Sr. et al.
6,311,742 B1 * 11/2001 Nusen ..... B67D 7/48 141/198
6,341,629 B1 1/2002 Clark et al.
6,478,058 B1 * 11/2002 Pears ..... B65D 25/48 141/255
6,520,222 B2 * 2/2003 Carmack ..... B67D 7/52 141/206
6,705,550 B2 * 3/2004 Bell ..... B67D 7/54 239/533.1
7,748,419 B2 * 7/2010 Fink, Jr. ..... B67D 7/42 141/116
8,051,164 B2 11/2011 De Peuter et al.
8,347,924 B2 1/2013 Meyer
8,499,802 B2 8/2013 Falckenberg et al.
8,695,648 B2 4/2014 Meyer
8,770,237 B2 7/2014 Bolt et al.
8,807,180 B2 8/2014 O'Connor
8,863,791 B2 10/2014 Achle et al.
8,919,393 B2 12/2014 Budzyk et al.
9,126,820 B2 9/2015 Gray et al.
9,242,849 B2 1/2016 Kunter et al.
9,266,710 B2 2/2016 Fedde et al.
9,527,720 B2 * 12/2016 Clever ..... B67D 7/42
2009/0188923 A1 7/2009 Versaw, Jr. et al.
2010/0090138 A1 4/2010 Bromley
2010/0126626 A1 5/2010 Falckenberg et al.
2011/0162753 A1 7/2011 Bolt et al.
2011/0277880 A1 11/2011 Meyer
2014/0048173 A1 2/2014 Fedde et al.
2014/0130939 A1 5/2014 Kunter et al.

* cited by examiner

NOZZLE FOR DELIVERY OF AUXILIARY OR ADDITIVE FLUID FOR TREATING EXHAUST FOR A DIESEL MOTOR FOR AUTOS OR TRUCK VEHICLE OR THE LIKE

CROSS REFERENCE TO RELATED APPLICATION

This application is a non-provisional application of the provisional application having Ser. No. 62/710,677 filed on Feb. 23, 2019.

FIELD OF INVENTION

This invention primarily relates to the structural modifications to a fuel dispensing nozzle, particularly one with relatively few moveable components within the nozzle spout, and for use for dispensing of specialized fluid additive, such as urea, when filling a vehicle with diesel exhaust fluid, used for treating the exhaust generated for any vehicle, such as a diesel automobile, truck, or other vehicular device.

BACKGROUND OF THE INVENTION

There are certain requirements that have been enacted both nationally, in various states, and even in select foreign countries, where additives need to be mixed with certain fuels in order to reduce the pollution effects of the fuel when it is combusted, during operations of a vehicle. For example, it is known that the separate addition of urea solution to a vehicle has the effect of eliminating or reducing the nitrogen oxide emissions from the exhaust of diesel engines that power these types of vehicles, and these diesel exhaust fluids are dispensed into usually a separate tank within the vehicle, for eventual intermixing with the exhaust, to reduce these types of emissions during operations of the vehicle. As known, a urea solution is already applied as an auxiliary liquid in the heavy type of diesel vehicles, such as trucks, but it is also contemplated that such fluid will also be applied and used in diesel passenger motor vehicles, for the future.

But, when the urea solution is added to the vehicle, because of its potentially caustic effects upon the various components of the vehicle, or even its proximate fender where the fluid is added through the use of a specialized nozzle, it is essential that the design and construction of the nozzle needs to be perfected whereby little or no drippage will be encountered when the solution is added to the separate vehicle tank. To achieve this, usually the nozzle has various safety valves that completely shut off any flowage or even the residual drippage of any such solution, during its application to the vehicle.

The applicant herein, has developed a dripless spout, in the past, which was used in the dispensing of standard fuels to the vehicle, in order to prevent any drippage of fuel usually after completion of a fueling procedure, and prevent the drippage of gasoline onto the ground, which may have a tendency to create isolated vapors during and after fuel dispensing. This can be seen in the applicant's U.S. Pat. No. 7,063,112, upon fuel dispensing nozzle having a dripless spout. The applicant also obtained U.S. Pat. No. 7,748,419, upon a dripless means for a fuel dispensing nozzle. As stated, these particular patented devices were for use with the standard nozzle, when dispensing gasoline and related fuels directly to a vehicle fuel tank, and not necessarily for application in dispensing of a specialized solution, such as a quantity of urea, to another tank in the same vehicle, when the dripless characteristics are even more demanded.

The applicant has also previously designed various types of dispensing nozzles for specialty fuels, as can be seen in U.S. Pat. No. 5,474,115, relating to a specialty fuel dispensing nozzle.

Of more recent origin, there are filling nozzles that are designed for specific applications in dispensing a specialty fuel or solution to a vehicle, and can only be inserted and rendered operative into a vehicle fuel tank, to hold such specialty fuel, such as a urea solution, due to the unique dimensions of the nozzle spout, and to attain its opening to allow the dispensing of the specialty solution, when the nozzle spout is applied into the filler neck or the fuel pipe of the vehicle fuel tank. Such can be seen in the filling nozzle U.S. Pat. No. 9,242,849, which defines a filling nozzle for dispensing a liquid into a tank of a motor vehicle, which is rendered operative when its spout inserts within the filler neck, and various valves are unseated through movement of the spout therein, in preparation for dispensing of said solution to an isolated tank within the vehicle.

An example of the type of tank assembly that can be used for storing such solutions can be seen in the published application No. U.S.2008/0188923, defining a urea solution tank assembly.

Published application No. U.S.2014/0048173, shows a fuel nozzle, also having a safety device provided therein, for movement from a blocking position to an enabling position, and wherein the valve device is closed regardless of the position of the actuating lever, for the fuel nozzle.

These are examples the current known prior art relating to this technology, particularly with respect to the delivery to a vehicle fuel tank, or its auxiliary tank, of a specialty fuel or additive, in this particular instance, of the type designed to reduce pollutant emissions, particularly from the combustion exhaust of diesel fuel within a diesel engine for an automobile, truck engine, or for other related vehicles.

SUMMARY OF THE INVENTION

This invention primarily relates to the dispensing of an auxiliary or additive fluid for use with or combining with primarily diesel or related fuels for a passenger vehicle, a truck, or other vehicle, that combusts diesel fuel to attain its operations.

The structure, function, and operations of the vehicle nozzle design of this invention generally relates to various modifications made to the spout structure of the fluid dispensing nozzle. As stated, in this particular instance, the nozzle is used for dispensing a specialty fluid or additive to a separate fluid tank of a diesel operative vehicle, or to an auxiliary tank, from which the alternative fluid may be dispensed, to the vehicle generated exhaust, during its operations. In this specific instance, it is for use for dispensing diesel exhaust fluid into a tank of a motor vehicle, generally having a diesel engine, wherein the specialty fluid added is identified as an aqueous urea solution.

The nozzle of this invention, and the modifications to its spout, are intended to enhance the dripless feature of the nozzle spout, and secondly, to incorporate centrally within the spout structure various valves, and safety valves, that can be manipulated into their open and operative positions when the nozzle spout is inserted into the fuel pipe of the vehicle, that urges select of its spout components to be shifted axially, so that its centrally arranged valves can be conveniently opened, after insertion of the nozzle spout into the vehicle, during refueling of this type of specialty solution.

More specifically, the nozzle spout of this invention is intended to be incorporated and used with a standard form of nozzle, that includes the nozzle, its handle guard, the nozzle opening lever, and further incorporated within its structure is the usual poppet valve, that functions as the main valve for opening and the dispensing of diesel fuel through the nozzle, and it also has its automatic shut-off means provided just forwardly thereof, which provides for the automatic shut off of the dispensing of fuel through the nozzle through closure of its poppet it valve, when the front of the spout encounters a fuel filled condition in the vehicle fuel tank, all as known in the art.

This invention provides structure that furnishes the movement and manipulation of an axially arranged primary safety valve, sleeve spring, a shiftable spout, and a vacuum check valve ball, all of which can be manipulated to attain an opening of the safety valve, in addition to the check valve, when desiring to dispense the specialized solution, such as urea, into its auxiliary tank, of the vehicle, during such fluid fill up.

The benefit of applicant's application herein is that all of these components are concentrically and axially arranged within the spout, so that no other pressures, such as lateral forces, will act upon these components as the nozzle spout is being pressed into the filler neck of the vehicle, which initiates the shifting of the various spouts, sleeves, and for attaining an opening of its safety valve, in addition to the check valve of the vacuum shut-off system, for the nozzle, during its functioning. In addition, various magnets are arranged predominantly surrounding the vacuum check valve, and also arranged in alignment therewith, so that no other energy sources are required to open these various valves, other than that magnetic attraction generated between the various magnets, as the sleeve structures are longitudally shifted with the spout, during its installation within the vehicle specialty fluid tank, for refueling, and specifically for delivering, in this instance, a urea solution to the vehicle, as a diesel exhaust fluid, in order to further reduce emissions and pollutants.

DESCRIPTION OF THE PREFERRED EMBODIMENT

Figure 1:
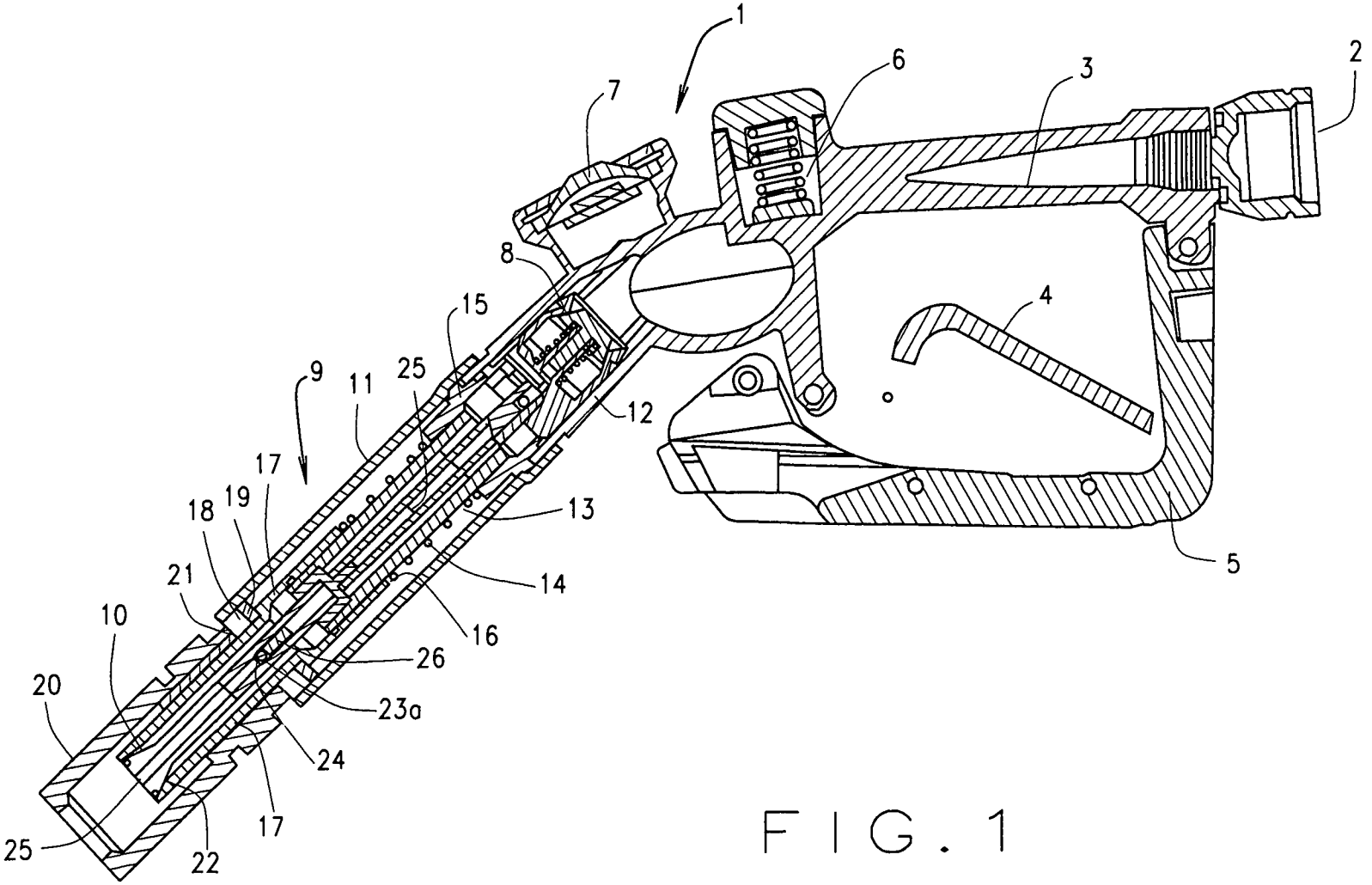
FIG. 1 shows a side sectional view of the diesel exhaust fluid nozzle of this invention, with its spout safety valve in closure.

In referring to the drawings, and in particular FIG. 1, therein is shown a sectional view of the nozzle 1 of this invention. The nozzle has the usual characteristics including its back inlet 2 to which the fluid line hose connects, or to a swivel, and has a flow path 3, provided therethrough, and further incorporates its handle lever 4 and its lever guard 5, as can be noted. At the forward portion of the handle is the poppet valve 6, which, as well known, is the primary valve that allows for passage of fluid through the nozzle, when it is opened, or provides for its closure, for curtailment of fluid dispensing. The automatic shut-off mechanism is provided at 7, and cooperates with the vacuum generated by its venturi 8, for shut-off of the poppet valve through operations of the said automatic shut-off 7, when a filled capacity for the vehicle fluid tank is detected by the forward end of the nozzle spout 9, during its operations.

The subject matter of the current invention is concerned with the structure, the details, and the operations of the spout 9, that allows for specific dispensing of select fluids or fuels, such as urea solution, through the nozzle, when the spout cooperates with the fill pipe of the vehicle, for such a solution, during refueling of the vehicle with this type of a select additive.

As was previously explained, this type of a nozzle is to be used for dispensing diesel exhaust fluid, such a urea solution, into a separate vehicle fluid tank, of the diesel motor vehicle.

The specific construction of the spout 9, for the hose nozzle valve of this invention, for dispensing the solution into the identified tank of a motor vehicle, does include its main valve 6, generally identified as the poppet valve. The spout is provided according to this invention with a safety valve 10, at the forward end of the spout, that is arranged downstream from the main valve 6, and such safety valve can be moved from a closed position (as shown in FIG. 1), to an opened position (as shown in FIG. 2) by means of an opening movement directed to the structure surrounding the safety valve 10, so that the valve remains downstream, while the other components, to be identified, are shifted upwardly, within the nozzle spout, as it is inserted into the fill pipe of the auxiliary tank for the vehicle being serviced.

Generally, the spout includes an outer sleeve 11, that is affixed to the front of the nozzle, or a spout adaptor, as at 12. Provided within the sleeve 11 is a safety valve sleeve 13, and it is also fixed, by threaded connection, to the front of the nozzle 12, or its adaptor. Provided upon the valve sleeve 13 is a sleeve spring 14, and this spring is maintained on the valve sleeve 13, biases also against the front end of the nozzle, as at its connecting nut or adaptor 15, and at its front end, biases against the upper and inward end 16 of the lower spout portion 17 as noted. Provided upon the surface of lower spout 17 is a shiftable spacer or seal 18 and which includes a primary or outer magnet 19 as can be noted. The spacer 18, and its magnet 19, are secured about the lower spout 17, and can slide longitudally or axially for a short distance with the lower spout 17, as can be noted.

Figure 2:
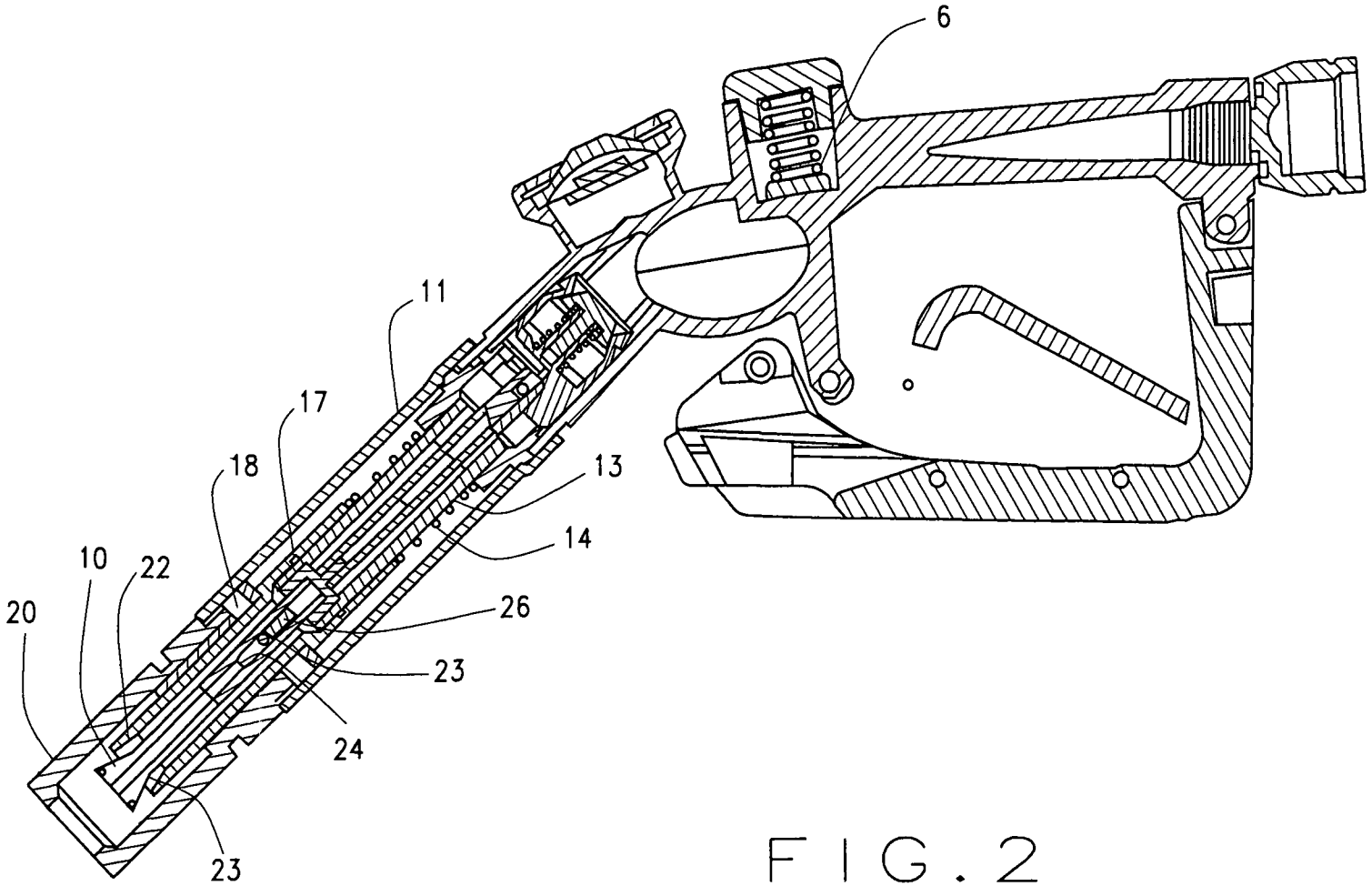
FIG. 2 is a side sectional view of the diesel exhaust fluid nozzle of this invention with its safety valve and vacuum check valve located within its spout in their opened conditions.

Thus, when the nozzle lower spout 17 is inserted within the fluid fill pipe 20 of the vehicle, the upper edge 21 of the fuel pipe biases against the seal 18, and forces it and its magnet 19 axially upwardly within the spout sleeve 11, against the bias of the sleeve spring 14, and when such occurs, the safety valve 10 remains stationary, but the lower spout sleeve 17 is urged axially inwardly, and thereby disengaging the safety valve 10 from its seat 22 within the lower spout sleeve 17, to open that particular valve, generally as can be noted at 23, in FIG. 2. When such occurs, the specialty fluid, when the nozzle is opened, by manipulation and elevation of its nozzle handle 4, will allow the specialty fluid to flow through the nozzle spout, after the poppet valve 6 for the nozzle has been opened. Thus, the nozzle will only allow the dispensing of the specialty fluid when the nozzle spout 17 is capable of being inserted within a particularly sized fill pipe 20, which must cooperate with the nozzle spout, to urge the spout sleeve 17 axially upwardly within the spout 11, in preparation for the dispensing of the diesel exhaust fluid of the dispensing system.

At the same time, when the lower spout sleeve 17 is in its closed position, with respect to the safety valve 10, the check valve ball 23*a* is seated against a valve seat 24 of the air return line 25 of the spout. When the lower spout sleeve 17 is urged rearwardly, a further magnet 26 which is pressed against the check valve 23 will be moved inwardly under the influence of the magnetic attraction from the primary magnet 19, as that magnet 19 and its spacer 18 are urged upwardly within the outer sleeve 11, and pull the magnet 26, and its check valve ball 23*a*, also upwardly, so as to open the air line 25 provided axially through the safety valve sleeve 13, as can be noted. Thus, when the specialty fluid is being dispensed, through opening of the nozzle, and the safety valve 10, the air return line 25 will likewise be placed into an open condition, allows for return of air back through the nozzle, and to shut-off 7, for usage, as known in the art.

Thus, as previously reviewed and explained, all of the various operative components of this invention are centrally applied, within the outer sleeve cover 11, and thereat are rendered operative simply by inserting the spout of the nozzle into the fill pipe 20, as noted, so that the upper edge of the fill pipe 21 biases against the seal 18, and forces it further inwardly within the outer sleeve 11, to prepare the nozzle for dispensing, and at the same time, to allow for staging the automatic shutoff, as explained. The opened condition for the nozzle, has already been explained and shown in FIG. 2, where the safety valve 10 is displaced from its valve seat 22, and at the same time, the check valve ball 23 is lifted from its seat 24 to also allow for the passage of air.

As could be understood, this particular specialty nozzle, in this particular instance for dispensing diesel exhaust fluid into a separate fluid tank of the vehicle, is provided with structure that is completely axially aligned within the spout sleeve, so that there are no lateral forces acting upon these various components, that could lead their early deterioration, and malfunctioning. All the operator needs to do is simply insert the spout of the nozzle into the particularly sized fill pipe of the vehicle, push it slightly further inwardly, and this stages the spout portion of the nozzle in preparation for dispensing of the specialty fluid, when the handle of the nozzle is manipulated into an opened condition, or opening of its main poppet valve 6, as explained.

Variations or modifications to the subject matter of this invention may occur to those skilled in the art upon review of the development as provided herein. Such variations, if within the spirit of this invention, are intended to be encompassed within the scope of any claims to patent protection issuing herein. The summary of the invention, its explanation in the specification, and its depiction of the drawings, are primarily set forth for illustrative purposes only.

I claim:

1. A fluid dispensing nozzle for dispensing an additive fluid to a fluid tank for treatment of exhaust for pollution reduction and for a diesel engine vehicle, said fluid dispensing nozzle having a spout construction at its forward end, such spout including an outer protective sleeve, a safety valve sleeve provided concentrically and axially arranged within the outer protective sleeve, said safety valve sleeve provided for the flow of the fluid therethrough, when the fluid dispensing nozzle is opened, a lower spout sleeve operatively and integrally associated and concentrically arranged with the safety valve sleeve, such that when the nozzle spout is inserted into a fill pipe of the vehicle, the lower spout sleeve is urged axially inwardly within the spout, due to its encountering an upper edge of the fill pipe of the vehicle, a safety valve extending through the safety valve sleeve and the lower spout sleeve, said safety valve having a valved end, the valved end provided for sealing against a valve seat proximate the outer end of said lower spout sleeve, to curtail the flow of any fluid through the fluid dispensing nozzle, when it is closed, but that said safety valve becomes unseated from the lower spout sleeve when the spout is inserted into the fill pipe of the vehicle, which urges the lower spout sleeve to be encountered and be urged inwardly of the spout within its safety valve sleeve, and a spring biased against the safety valve sleeve and biasing against an upper end of the lower spout sleeve and the forward end of the fluid dispensing nozzle to urge said lower spout sleeve into closure against the safety valve, when the fluid dispensing nozzle is shut off to curtail the flow of fluid into the vehicle.

2. The fluid dispensing nozzle for dispensing additive fluid to a diesel operative vehicle of claim 1, and including said safety valve extends entirely through the lower spout sleeve and the safety valve sleeve, and connects and seats proximate the forward end of the fluid dispensing nozzle.

3. The fluid dispensing nozzle for dispensing additive fluid to a diesel operative vehicle of claim 2, and including a passage extending entirely through the safety valve for the delivery of air to an automatic shutoff of the nozzle, and to initiate automatic shutoff as the dispensed fluid fills the fill pipe to a front end of the said safety valve and blocks the flow of air.

* * * * *